US010200797B2

(12) United States Patent
Pedersen et al.

(10) Patent No.: US 10,200,797 B2
(45) **Date of Patent: *Feb. 5, 2019**

(54) MICROPHONE INLET FOR HEARING AID

(71) Applicant: OTICON A/S, Smørum (DK)

(72) Inventors: Troels Holm Pedersen, Smørum (DK); Claus Tipsmark, Smørum (DK); Michael Frank Petersen, Smørum (DK); Brian Spidsbjerg, Smørum (DK); Lars Monroy, Smørum (DK); Lars Persson, Smørum (DK); Svend Oscar Petersen, Smørum (DK)

(73) Assignee: Oticon A/S, Smørum (DK)

( * ) Notice: Subject to any disclaimer, the term of this patent is extended or adjusted under 35 U.S.C. 154(b) by 0 days.

This patent is subject to a terminal disclaimer.

(21) Appl. No.: 15/868,597

(22) Filed: Jan. 11, 2018

(65) Prior Publication Data

US 2018/0139547 A1 May 17, 2018

Related U.S. Application Data

(63) Continuation of application No. 15/061,154, filed on Mar. 4, 2016, now Pat. No. 9,900,713.

(30) Foreign Application Priority Data

Mar. 5, 2015 (EP) ..... 15157823

(51) Int. Cl.
*H04R 1/40* (2006.01)
*H04R 25/00* (2006.01)
(Continued)

(52) U.S. Cl.
CPC ..... *H04R 25/48* (2013.01); *H04R 1/222* (2013.01); *H04R 1/28* (2013.01); *H04R 25/604* (2013.01); *H04R 25/608* (2013.01); *H04R 25/65* (2013.01)

(58) Field of Classification Search
CPC combination set(s) only.
See application file for complete search history.

(56) References Cited

U.S. PATENT DOCUMENTS 2,833,868 A 5/1958 Kojis et al.
6,597,793 B1 7/2003 Darbut et al.
(Continued)

FOREIGN PATENT DOCUMENTS

DE 10 2007 034 230 A1 1/2009
DE 10 2010 009 781 A1 9/2011
(Continued)

*Primary Examiner* — Amir Etesam
(74) *Attorney, Agent, or Firm* — Birch, Stewart, Kolasch & Birch, LLP

(57) ABSTRACT

The disclosure relates to an inlet member for a microphone system in a hearing instrument, such as a hearing aid, wherein the inlet member has a main body portion having a first portion and a second portion, the second portion being provided with a first recess for accommodating a microphone comprising a snout for conducting sound energy into the interior of the microphone, wherein the first recess is provided with a sound channel formed for engagement with the snout of the microphone, where the sound channel at the end hereof facing away from the microphone is acoustically coupled to a third recess in the first portion, the third recess being defined by wall portions that provide a seal to corresponding inner surface portions of a hearing instrument, in which the inlet member is mounted.

23 Claims, 4 Drawing Sheets

(51) Int. Cl.
*H04R 1/22* (2006.01)
*H04R 1/28* (2006.01)

(56) References Cited

U.S. PATENT DOCUMENTS

| | | | | |
|---|---|---|---|---|
| 9,357,292 | B2 | 5/2016 | Huang et al. | |
| 2006/0034473 | A1 | 2/2006 | Halteren et al. | |
| 2007/0053538 | A1 | 3/2007 | Jensen | |
| 2007/0127759 | A1* | 6/2007 | Zhang | H04R 1/342 381/338 |
| 2007/0140517 | A1 | 6/2007 | Ruzicka et al. | |
| 2008/0298620 | A1 | 12/2008 | Ho et al. | |
| 2009/0252365 | A1* | 10/2009 | Lin | H04R 1/08 381/369 |
| 2010/0067732 | A1 | 3/2010 | Hachinohe et al. | |

FOREIGN PATENT DOCUMENTS

| | | | |
|---|---|---|---|
| WO | WO 2010/034353 | A1 | 4/2010 |
| WO | WO 2010/117334 | A1 | 10/2010 |

* cited by examiner

MICROPHONE INLET FOR HEARING AID

CROSS-REFERENCE TO RELATED APPLICATION

This application is a Continuation of co-pending application Ser. No. 15/601,154, filed on Mar. 4, 2016, which claims priority under 35 U.S.C. § 119(a) to Application No. 15157823.4, filed in Europe on Mar. 5, 2015, all of which are hereby expressly incorporated by reference into the present application.

The present disclosure relates generally to hearing instruments and more particularly to the provision of microphones in hearing aids.

The main purpose of a microphone inlet in a hearing instrument is to let sound from the surroundings enter the microphone that is provided inside the hearing instrument. The sound enters the inlet opening on the surface of the hearing instrument and is then guided through the inlet to the microphone that is provided inside the hearing instrument. To avoid that this sound is mixed with sounds from the hearing aid itself or with sound entering through other openings in the casing of the hearing instrument it is important that the inlet passage is tight. Furthermore, the inlet needs to function as an acoustic low-pass filter, to avoid e.g. ultrasounds to enter the microphone. An inlet opening that is situated at the surface of the hearing instrument tends to let contaminants as for instance dirt, sweat, sebum and earwax enter into the inlet of the microphone. These contaminants tend to damage the microphone that is provided inside the hearing instrument.

In many hearing instruments, the inlet is provided in a part or member that is made up by a separate hard plastic part that is glued and sealed to the microphone in one end and that exits with a tube through the hearing instrument's surface at the other end. Alternatively, the inlet in the inlet part or member exits the instrument with a gasket between the hard inlet part or member and a hole in the outer shells in the hearing instrument.

In summary, some of the main requirements of hearing instrument microphone inlets are:

- The microphone inlet part or member should preferably provide a tight fitting/seal to the hearing instrument casing for all tolerance cases; and/or
- The microphone inlet part or member should preferably protect the microphone from contaminants entering the microphone through the inlet part or member; and/or
- The microphone inlet part or member should preferably function as an acoustic low pass filter with the required filter characteristics, such as upper limiting frequency.

Therefore there is a need to provide an inlet system and/or inlet part or member for one or more microphones in a hearing instrument that preferably fulfill at least one or all of the main requirements mentioned above.

According to a first aspect of the present disclosure there is provided an inlet system for one or more microphones in a hearing instrument, such as, but not limited to, a hearing aid, which system comprises an inlet member with a main body portion having a second portion in which there is provided at least one recess formed for accommodating a microphone, which microphone comprises a body and a sound inlet member or snout for conducting sound into the interior of the microphone. The at least one recess in the main body portion is provided with a first sound channel formed to enter into tight engagement with the sound inlet member or snout of the microphone, such that sound energy entering the first sound channel at the distal end hereof relative to the microphone will pass through the first sound channel and into the sound inlet member or snout of the microphone.

The distal end of the first sound channel described above is acoustically coupled to a cavity. The cavity is either formed as an integral part of the main body portion of the inlet system, or the cavity is defined partly by surface portions of the main body of the inlet system and partly by inner surface portions of the hearing instrument.

From the cavity there extends at least one second sound channel that provides acoustic communication between the cavity and an outer surface portion of the hearing instrument.

In an embodiment of the first aspect of the present disclosure the main body of the inlet system comprises two separate recesses provided in the second portion of the main body, each formed for accommodation of a separate microphone. Each of these separate recesses are provided with a first sound channel formed to enter into tight engagement with the sound inlet member or snout of the respective microphone provided in that recess, such that sound energy entering the channel at the distal end hereof relative to the microphone will pass through the respective first sound channel and into the sound inlet member of the respective microphone.

The distal end of the respective first sound channel described above is acoustically coupled to respective separate cavities corresponding to each separate microphone and first sound channel. These cavities are provided in a first portion of the inlet member and are either formed as an integral part of the main body portion of the inlet system, or the cavity is defined partly by surface portions of the main body of the inlet system and partly by surface portions of the hearing instrument. As an alternative, one cavity can be formed as an integral part of the main body, whereas the other cavity can be defined partly by surface portions of the main body of the inlet system and partly by surface portions of the hearing instrument.

From each separate cavity there extends at least one second sound channel that provides acoustic communication between the specific cavity and an outer surface portion of the hearing instrument. In this manner, sound can be picked up at two different locations on the outer surface of the hearing instrument, whereby a directional microphone system can be provided.

In an embodiment of the present disclosure, the main body of the inlet member is releasably provided between the one or more microphones in the hearing instrument and an inner surface portion of a part of the casing of the hearing instrument. This allows for removal and replacement of the main body and hence for the possibility to replace it with another main body having other characteristics (such as size of recesses and cavities). Also removal of the main body from the hearing instrument may facilitate cleaning of the main body from contaminants collected in the cavities.

The above mentioned part of the casing of the hearing instrument can be provided with a openable or removable lid, such that access is provided to the one or more cavities when the lid is opened or removed from the hearing instrument, whereby contaminants collecting in the cavities can easily be removed.

In an embodiment of the present disclosure the main part of the inlet member is made of vulcanized rubber, but it is understood that other materials may alternatively be used without departing from the scope of the disclosure. The material preferably has a dampening effect so as to minimize noise from the housing. The rubber material may lower or raise the resonant frequency of the structure and/or hearing aid compared to a harder material.

In an embodiment of the present disclosure the two recesses for the two separate microphones are separated by a compartment or recess formed for accommodating a telecoil that is provided in the hearing instrument.

According to a second aspect of the present disclosure there is provided an inlet member for one or more microphones in a hearing instrument, such as, but not limited to, a hearing aid, the inlet member having a main body portion comprising a second or rear surface, in which there is provided at least one first recess formed for accommodating a microphone, which microphone comprises a body and a sound inlet member or snout for conducting sound into the interior of the microphone. The at least one first recess in the main body portion of the inlet member is provided with a first sound channel formed to enter into tight engagement with the sound inlet member or snout of the microphone, such that sound energy entering the first sound channel at the distal end hereof relative to the respective microphone will pass through the first sound channel and into the sound inlet member or snout of the respective microphone.

The distal end of the first sound channel described above is acoustically coupled to a second recess provided at the first portion of the main body of the inlet member facing away from the above mentioned second portion of the main body of the inlet member in which the first recess for accommodating the microphone is provided.

When installed in a hearing instrument, the second recess will define a cavity together with adjacent inner surface portions of the housing of the hearing instrument. From the respective of this or these cavities second sound channels provides acoustic communication to outer surface portions of the housing of the hearing instrument.

The provision of a removable/replaceable inlet member according to the present disclosure has several important advantages. Thus the inclusion of the cavity in the inlet member in front of the inlet to the microphone tends to reduce the risk of contaminants reaching the interior of the microphone and hence destroying the microphone. According to the disclosure, contaminants will tend to collect in the one or more cavities of the inlet member, from which cavities it will be easy to remove the contaminants by for instance removing the inlet member from the hearing instrument as described above.

Further, the volume of the cavities together with the above mentioned sound channels connecting the respective cavities to the outer surface of the hearing instrument (as well as the first sound channels leading from the respective cavity to the respective microphone inlet or snout) will provide an acoustic low pass filter and the upper frequency limit of this filter will be determined inter alia by the dimension of the specific cavity and the length and cross sectional area of the corresponding sound channels. Hence, according to the present disclosure, it is possible to provide different inlet members having different volumes of the one or more cavities and thereby choosing between different characteristics of the acoustic low pass filters.

Further, the provision of the inlet member according to the present disclosure makes it easy to make the second sound channel leading from the cavity to the outer surface of the hearing instrument exit at different positions on the outer surface without the need for changing the design of the inlet member. Thus, for instance, the second sound channel may exit on top of the hearing instrument or on one of the sides of the hearing instrument still using the same inlet member.

According to an embodiment of the second aspect of the present disclosure the first sound channel extends a distance into the corresponding second recess formed in the first portion of the inlet member, such that a shoulder or edge portion is formed between the entrance of the first sound channel and the adjacent wall portion of the second recess, whereby the passage of contaminants from the second recess via the first sound channel to the interior of the microphone that is coupled to the sound channel will be prevented or reduced.

As described above, the inlet member may comprise more than one recess at the second portion of the inlet member for accommodating a separate microphone in each of these recesses and corresponding recesses provided on the first portion of the inlet member. It is understood that the respective sound channels leading from a given recess in the second portion to the corresponding recess in the first portion of the inlet member can be provided with respective shoulder or edge portions in the manner described above.

According to a third aspect of the present disclosure there is provided a hearing instrument, such as, but not limited to, a hearing aid, comprising an inlet member according to the second aspect of the disclosure.

According to an embodiment of the third aspect of the present disclosure the hearing instrument comprises at least one microphone and an inlet member as described above, where the inlet member is removably mounted in the hearing instrument and where the microphone is acoustically coupled to at least one opening provided in the housing of the hearing instrument via the inlet member.

According to an embodiment of the third aspect of the present disclosure the housing of the hearing instrument is provided with an openable lid portion that provides access to the inlet member. Thus by opening the lid portion it is possible to provide access to the inlet member, which can then be cleaned of contaminants without having to remove the inlet member from the hearing instrument's housing. By removing the top shell portion of the hearing instrument it is possible to remove the inlet member from the hearing instrument instance for cleaning of the inlet member or for replacement of the inlet member in case alternative acoustic characteristics of the low pass filter formed by inter alia the inlet member are required.

It is expressly noted that although the present disclosure is exemplified in the following detailed description of the disclosure by an inlet member formed for accommodating two microphones and a telecoil, this does not constitute a limitation of the scope of the disclosure. Thus, for instance, the scope also comprises inlet members formed for accommodation only a single microphone or more than two microphones. Similarly, the inlet member according to the present disclosure does not necessarily comprise compartment(s) for a (or more) telecoils(s).

It is furthermore noted that the term "hearing instrument" comprises any device that is designed for aiding a person suffering from a hearing impairment. In the following detailed description, the present disclosure is exemplified by a behind-the-ear hearing aid, but it is expressly noted that this does not constitute a limitation of the scope of the present disclosure.

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with a number of or all features of the other aspects. These and other aspects, features and/or technical effect will be apparent from and elucidated with reference to the illustrations described hereinafter in which:

Figure 2A:
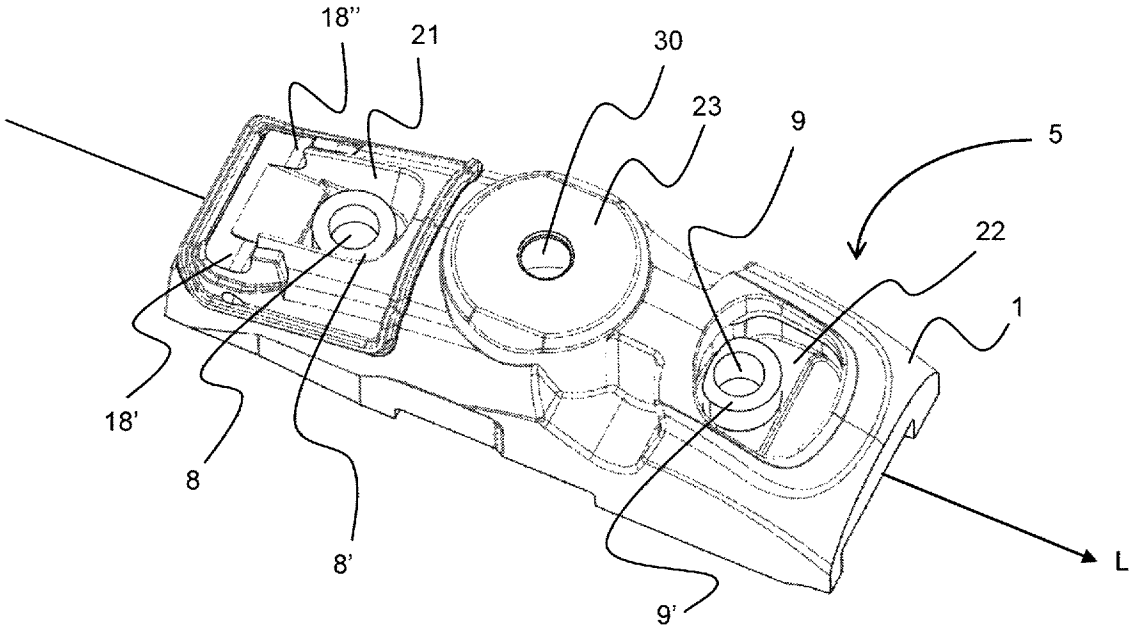
FIG. 2A illustrates an embodiment of an inlet member according to the present disclosure by means of a schematical perspective view seen from above at an inclined angle showing inter alia two cavities in the inlet member.
Figure 2B:
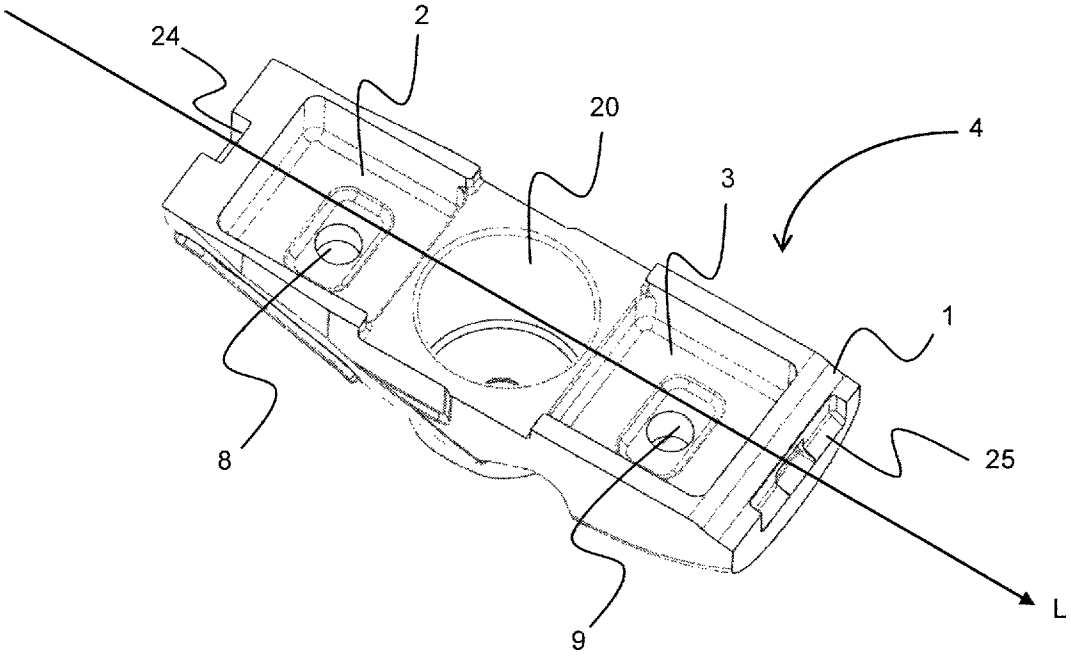
Figure 3:
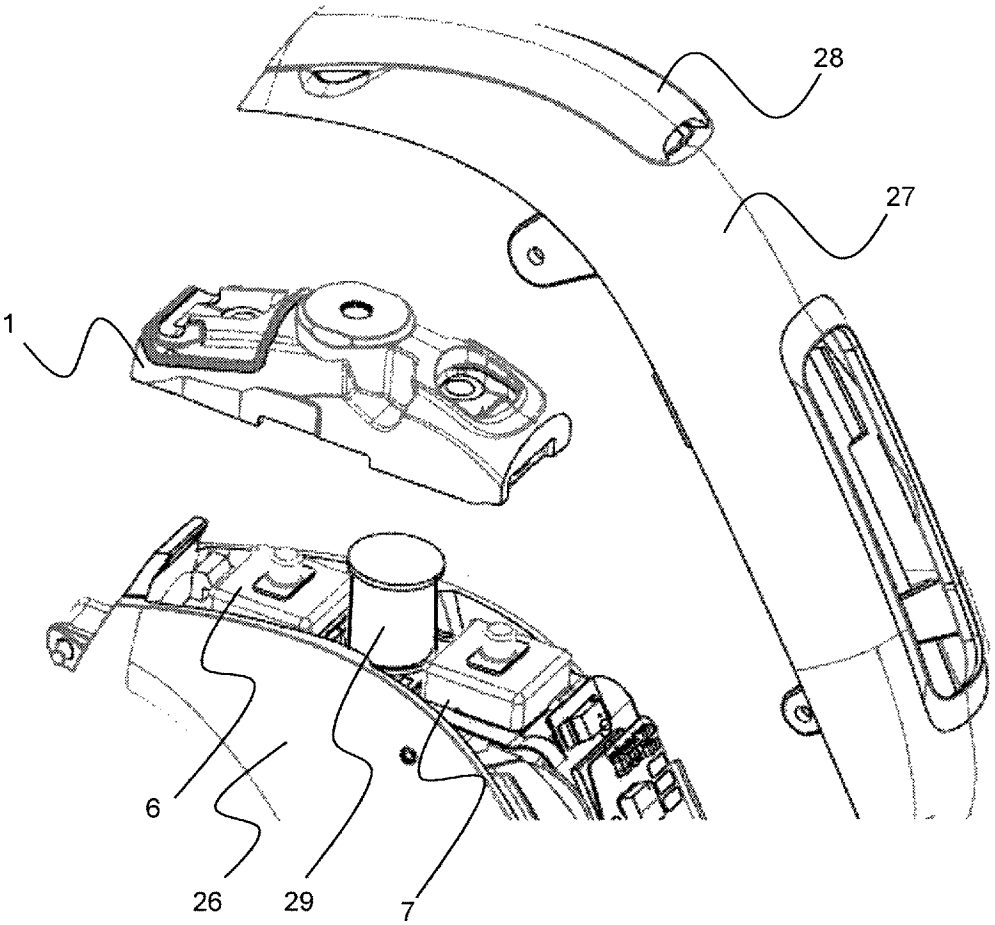

FIG. 2B illustrates the embodiment of an inlet member shown in FIG. 2A seen at an inclined angle from below showing inter alia recesses formed for accommodating two separate microphones and a central recess formed for accommodating a telecoil; and FIG. 3 illustrates the positioning of an embodiment of the inlet member according to the present disclosure in a hearing instrument (a behind-the-ear hearing aid).

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details. Several aspects of the disclosure are described in the following.

The hearing instrument is adapted to be worn in any known way. This may include i) arranging a unit of the hearing device behind the ear with a tube leading air-borne acoustic signals into the ear canal or with a receiver/loudspeaker arranged close to or in the ear canal such as in a Behind-the-Ear type hearing aid, and/or ii) arranging the hearing device entirely or partly in the pinna and/or in the ear canal of the user such as in a In-the-Ear type hearing aid or In-the-Canal/Completely-in-Canal type hearing aid, or iii) arranging a unit of the hearing device attached to a fixture implanted into the skull bone such as in Bone Anchored Hearing Aid or Cochlear Implant, or iv) arranging a unit of the hearing device as an entirely or partly implanted unit such as in Bone Anchored Hearing Aid or Cochlear Implant.

In general, a hearing device includes i) an input unit such as a microphone for receiving an acoustic signal from a user's surroundings and providing a corresponding input audio signal, and/or ii) a receiving unit for electronically receiving an input audio signal. The hearing device further includes a signal processing unit for processing the input audio signal and an output unit for providing an audible signal to the user in dependence on the processed audio signal.

The input unit may include multiple input microphones, e.g. for providing direction-dependent audio signal processing. Such directional microphone system is adapted to enhance a target acoustic source among a multitude of acoustic sources in the user's environment. In one aspect, the directional system is adapted to detect (such as adaptively detect) from which direction a particular part of the microphone signal originates. This may be achieved by using conventionally known methods. The signal processing unit may include amplifier that is adapted to apply a frequency dependent gain to the input audio signal. The signal processing unit may further be adapted to provide other relevant functionality such as compression, noise reduction, etc. The output unit may include an output transducer such as a loudspeaker/receiver for providing an air-borne acoustic signal transcutaneously or percutaneously to the skull bone or a vibrator for providing a structure-borne or liquid-borne acoustic signal. In some hearing devices, the output unit may include one or more output electrodes for providing the electric signals such as in a Cochlear Implant.

Figure 1:
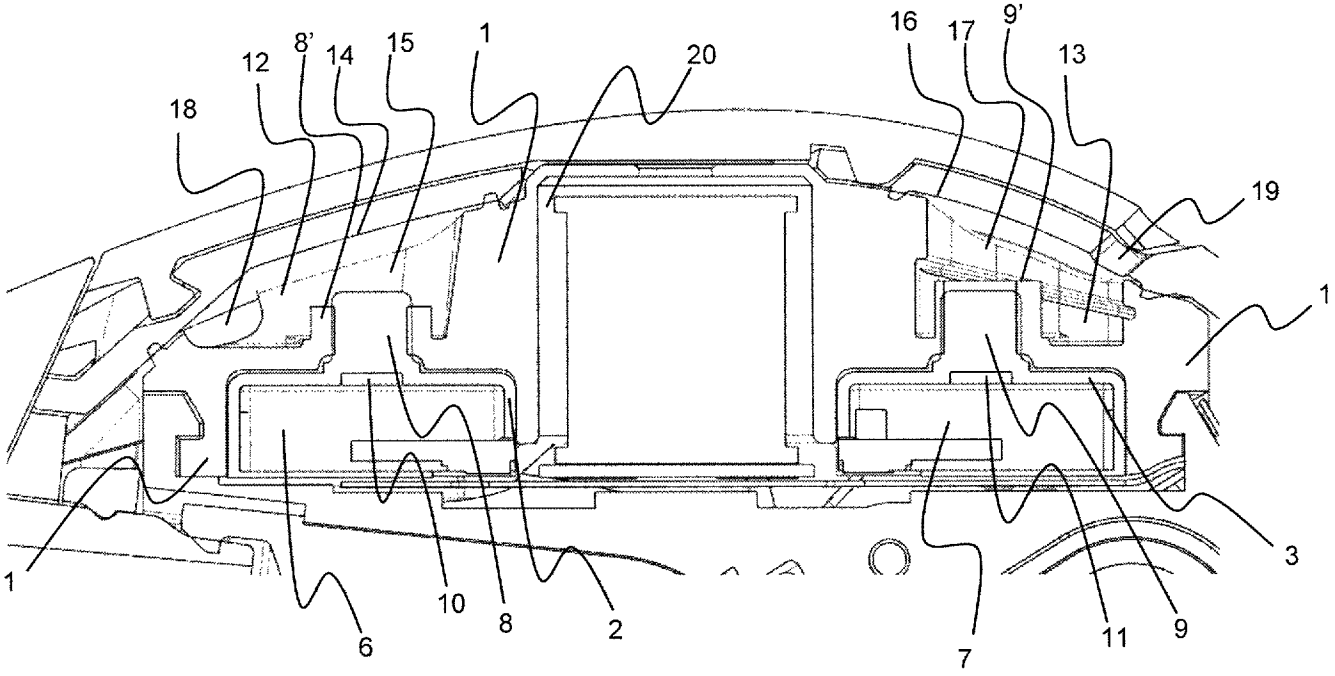
FIG. 1 illustrates a cross sectional view of a hearing instrument (a behind-the-ear hearing aid) as seen from the side showing an inlet system according to an embodiment of the present disclosure.

Now referring to FIG. 1 there is shown an embodiment of an inlet system for a hearing instrument according to the first aspect of the present disclosure. The inlet system according to this embodiment comprises an inlet member 1. The inlet member 1 is in the shown embodiment provided with a first recess 2 and a second recess 3 both provided in the second portion 4 (see FIG. 2B) of the inlet member 1. It is understood that the presence of two recesses does not pose a limitation and that other numbers of recesses could be provided if required. The first recess 2 is formed such that it can accommodate a first microphone 6 and the second recess 3 is formed such that it can accommodate a second microphone 7.

From the bottom surface of the first recess 2 there extends a first sound channel 8 that provides acoustic communication between the inlet member or snout 10 of the first microphone 6 and a first cavity 12 that is defined between a portion of the outer surface of the first portion 5 of the inlet member 1 and inner surface portions 14, 15 of the housing of the hearing instrument. Similarly, from the bottom surface of the second recess 3 there extends a second sound channel 9 that provides acoustic communication between the inlet member or snout 11 of the second microphone 7 and a second cavity 13 that is defined between a portion of the outer surface of the first portion 5 of the inlet member 1 and inner surface portions 16, 17 of the housing of the hearing instrument. The cavity 12 further has the function of performing filtering of ultrasound in the incoming sound signal from the environment. This help reduce unwanted artefacts or sounds, in the ultra sound range, in the signal reaching the microphone. Further, this will make the hearing instrument less sensitive to the detrimental influences of ultrasound used in e.g. room sensors and automatic door openers and the like.

From the first cavity 12 there extends at least one third sound channel 18 that provides acoustic communication between the first cavity 12 and a first outer surface portion of the hearing instrument.

From the second cavity 13 there extends at least one fourth sound channel 19 that provides acoustic communication between the second cavity 13 and a second outer surface portion of the hearing instrument.

In an embodiment of the present disclosure that is shown in FIGS. 1 and 3, the main body of the inlet member 1 is releasably provided between the one or more microphones 6, 7 in the hearing instrument and inner surface portions of the housing of the hearing instrument. This allows for removal and replacement of the main body and hence for the possibility to replace it with another main body having other characteristics (such as size of recesses and cavities). Also removal of the main body from the hearing instrument may facilitate cleaning of the main body from contaminants collected in the cavities.

The embodiment of the present disclosure shown in FIGS. 1, 2 and 3 comprises a further recess or compartment 20, centrally located between the first and second recess 2 and 3. The recess or compartment 20 is formed for accommodation of a telecoil provided in the hearing instrument (see FIG. 3).

The hearing instrument can be provided with a openable or removable lid, such that access is provided to the one or more cavities in the first portion of the inlet member 1 when the lid is opened or removed from the hearing instrument, whereby contaminants collecting in the cavities can easily be removed. As shown in FIG. 3, the housing of the hearing instrument can comprise a top shell portion that can be removed from the rest of a bottom shell portion, whereby the entire inlet member 1 can be removed from the hearing instrument for clearing or replacement.

In an embodiment of the present disclosure the inlet member is made of vulcanized rubber, but it is understood that other materials may alternatively be used without departing from the scope of the disclosure.

The two recesses for the two separate microphones being separated by a compartment or recess formed for accommodating a telecoil that is provided in the hearing instrument.

Referring to FIGS. 2A and 2B an inlet member 1 defined by a longitudinal axis L according to an embodiment of the present disclosure as illustrated. In FIG. 2A the inlet member 1 is seen from above, i.e towards the first portion 5 of the inlet member, whereas in FIG. 2B the inlet member is seen from below, i.e. towards the second portion 4 of the inlet member. It is noted that details shown in FIGS. 2A and 2B corresponding to those shown in FIG. 1 are designated by the same reference numbers.

As illustrated in FIG. 2A, the inlet member 1 on the first portion 5 hereof comprises third and fourth recesses, designated 21 and 22, respectively, which—together with appropriate inner surface portions of the hearing instrument—form the above mentioned first and second cavities 12 and 13, respectively. At the respective bottom portions of the two recesses 12 and 13 there extends the above mentioned first and second sound channels 8 and 9, respectively, that lead to the respective microphones 6 and 7 beneath the inlet member. In the shown embodiment, at one longitudinal end of the recess 12 there is provided passageways 18' and 18" that provides acoustic communication to corresponding openings in outer surface portions of the hearing instrument, when the inlet member is mounted in the hearing instrument. The second recess 13 is in the shown embodiment not provided with an outward passageway, as this passageway in the embodiment of the microphone system illustrated in FIGS. 1 and 3 is provided in the upper portion (or in the lid) of the hearing instrument. It is however understood that also the fourth recess 22 could alternatively be provided with one or more passageways providing acoustic communication with corresponding openings in outer surface portions of the hearing instrument.

In the embodiment shown in FIGS. 2A and 2B a compartment for accommodating a telecoil is provided longitudinally between the two recesses 21 and 22. The upper covering portion of this compartment is designated by reference numeral 23.

As illustrated in FIG. 1, and similar in at least in FIG. 2A, the inlet member is configured to accommodate two input devices, e.g. two microphones, located at respective opposite sides of the compartment for accommodating the telecoil, so seen along the longitudinal length of the inlet member 1 in the side view of FIG. 1, a first microphone may be located to the left of the compartment 23, and a second microphone may be located to the right of the compartment 23.

Referring to FIG. 2B there is shown the second portion 4 of the inlet member 1 according to the embodiment illustrated in FIGS. 1 and 2A. FIG. 2B shows the first and second recesses 2 and 3, respectively, formed for accommodating the microphones 6 and 7, respectively, or at least a part of these microphones. From these respective recesses there extend the first and second sound channels 8 and 9, respectively that correspond to the respective microphone inlet members or snouts 10 and 11, respectively. Further, the compartment 20 for the telecoil is shown.

Now referring to FIG. 3, there is shown an illustration of the positioning of the embodiment of the inlet member 1 according to the present disclosure that has been described in detail above in a hearing instrument. The hearing instrument is exemplified by a behind-the-ear hearing aid comprising a bottom shell body 26 and an top shell body 27, which latter is provided with a lid 28, through which access to the microphone inlet member 1 can be obtained. This access allows for the possibility to clean the cavities 12 and 13 (see FIGS. 1 and 2) that are formed between the inlet member 1 and corresponding inner surface portions of the hearing instrument. Removal of the inlet member 1 from the housing of the hearing instrument requires (at least in case the inlet member 1 is mounted within a behind-the-ear hearing aid as described in FIG. 3) that the top shell portion 27 be removed from the bottom shell portion 26 of the hearing aid. FIG. 3 also shows the presence of a telecoil 29 between the two microphones 6 and 7, respectively, but it is understood that the scope of the disclosure—as defined by the appended claims—is not limited to the presence of a telecoil or a compartment herefore in the microphone inlet member.

When assembling the system comprising the microphone inlet member 1 and the various portions of a hearing instrument, the inlet member 1 (which could be made from rubber) is mounted on top of the microphones (see FIG. 1 or 3), after which the top shell portion 27 is mounted on top of the microphone member 1. The inlet member provides a tight or sealed connection between the respective microphone and the outer surface of the shell of the hearing instrument with four sealing surfaces:

1. Between the inlet member 1 and the snout 10 of the first microphone 6;
2. Between the inlet member 1 and the outer shell of the hearing instrument at the first cavity 12;
3. Between the inlet member 1 and the snout 11 of the second microphone 7; and
4. Between the inlet member 1 and the outer shell of the hearing instrument at the second cavity 13.

The inlet member parts comprising the sound channels and the corresponding first and second recesses constitute acoustical lowpass filters when interacting with the respective passageways leading to the outer surface of the hearing instrument and the cavities formed between the first and second recesses, respectively and the corresponding inner surface portions of the hearing instrument. The inlet member protects the microphones from contamination with sharp edged "chimneys" (one for each microphone as indicated by reference numbers 8' and 9', respectively, in FIG. 1) that prevents contaminants from running along the inner surfaces of the first and second cavities 12, 13, respectively, and into the respective microphone.

The characteristics of, especially the rear, inlet allow a filter to be mounted, such as web structure or plate with holes or other such suitable filter. One or more filters may be used, and not all inlets needs to be fitted with filters. The filter or filters are preferably used for minimizing physical contaminants reaching the microphone or microphones.

The telecoil support is constituted by a chamber 20 in the inlet member 1. After assembly, the telecoil chamber is filled though the hole 30 with coating that holds the coil in position in the chamber. Two undercuts 24, 25 in respective end portions of the inlet member 1 are used for holding the inlet member in position on the microphones until the outer shell 27 of the hearing instrument is mounted.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening elements may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

The present disclosure relates to the following items:

1. An inlet system for one or more microphones in a hearing instrument, such as a hearing aid, the system comprising an inlet member (1) with a main body portion having a first portion (5) and a second portion (4), the second portion being provided with a recess (2) formed for accommodating a microphone (6), the microphone comprising a microphone body and a sound inlet or snout (10) for conducting sound energy into the interior of the microphone (6), wherein the recess (2) is provided with a sound channel (8) formed for engagement with the sound inlet or snout (10) of the microphone (6), where the sound channel (8) at the longitudinal end hereof facing away from the microphone (6) is acoustically coupled to a cavity (12), from which cavity (12) there extends at least one sound channel (18) that provides acoustic communication between the cavity (12) and one or more outer surface portion(s) of the hearing instrument.

2. The inlet system according to item 1, wherein said cavity (12) is either formed as an integral part of the main body portion of the inlet system (1), or wherein the cavity (12) is defined partly by surface portions of the main body of the inlet system (1) and partly by surface portions of the hearing instrument.

3. The inlet system according to item 1 or 2, wherein said second portion (4) of said inlet member (1) is provided with a second recess (3) formed for accommodating a second microphone (7), the second microphone comprising a microphone body and sound inlet or snout (11) for conducting sound energy into the interior of the microphone (7), wherein the second recess (3) is provided with a second sound channel (9) formed for engagement with the sound inlet or snout (11) of the microphone (7), where the second sound channel (9) at the longitudinal end hereof facing away from the microphone (7) is acoustically coupled to a second cavity (13), from which second cavity (13) there extends at least one sound channel (19) that provides acoustic communication between the second cavity (13) and one or more outer surface portion(s) of the hearing instrument.

4. The inlet system according to item 3, wherein said second cavity (13) is either formed as an integral part of the main body portion of the inlet system (1), or wherein the second cavity (13) is defined partly by surface portions of the main body of the inlet system (1) and partly by surface portions of the hearing instrument.

5. The inlet system according to item 3 or 4, wherein said main body portion is furthermore provided with a compartment (20) for accommodating a telecoil.

6. The inlet system according to any one of the preceding items, wherein said main body of the inlet system (1) is made of a flexible or compressible material, such as rubber.

7. An inlet member for a microphone system in a hearing instrument, such as a hearing aid, wherein the inlet member (1) has a main body portion having a first portion (5) and a second portion (4), the second portion being provided with a first recess (2) formed for accommodating a microphone (6), the microphone comprising a microphone body and sound inlet or snout (10) for conducting sound energy into the interior of the microphone (6), wherein the first recess (2) is provided with a sound channel (8) formed for engagement with the sound inlet or snout (10) of the microphone (6), where the sound channel (8) at the longitudinal end hereof facing away from the microphone (6) is acoustically coupled to a third recess (21) formed in the first portion (5) of the main body of the inlet member (1), the third recess (21) being defined by wall portions that are formed to provide a seal to corresponding inner surface portions of a hearing instrument, when the inlet member is mounted in a hearing instrument.

8. The inlet member according to item 7, wherein said sound channel (8) extends a distance into said third recess (21) such that a shoulder portion (8') is formed between the entrance of the sound channel (8) and the adjacent wall portions of the third recess, whereby the passage of contaminants from the third recess (21) via the sound channel (8) to the interior of the microphone (6) that is coupled to the sound channel will be prevented or reduced.

9. The inlet member according to item 7 or 8, wherein said second portion (4) of said inlet member (1) is provided with a second recess (3) formed for accommodating a second microphone (7), the second microphone comprising a microphone body and sound inlet or snout (11) for conducting sound energy into the interior of the microphone (7), wherein the second recess (3) is provided with a second sound channel (9) formed for engagement with the sound inlet or snout (11) of the microphone (7), where the second sound channel (9) at the longitudinal end hereof facing away from the microphone (7) is acoustically coupled to a fourth recess (22) formed in the first portion (5) of the main body of the inlet member (1), the fourth recess (22) being defined by wall portions that provide a seal to corresponding inner surface portions of a hearing instrument, when the inlet member is mounted in a hearing instrument.

10. The inlet member according to any one of the items 7, 8 or 9, wherein said second sound channel (9) extends a distance into said fourth recess (22) such that a shoulder portion (9') is formed between the entrance of the sound channel (9) and the adjacent wall portions of the fourth recess (22), whereby the passage of contaminants from the fourth recess (22) via the sound channel (8) to the interior of the microphone (6) that is coupled to the sound channel will be prevented or reduced.

11. The inlet system according to any one items 7 to 10, wherein said main body portion of the inlet member (1) is furthermore provided with a compartment (20) for accommodating a telecoil.

12. The inlet system according to any one of the items 7 to 11, wherein said main body of the inlet member (1) is made of a flexible or compressible material, such as rubber.

13. A hearing instrument, such as a hearing aid, comprising at least one microphone (6) and an inlet member (1) according to any one of the items 7 to 12 removably mounted in the hearing instrument, wherein the microphone is acoustically coupled to at least one opening provided in the housing of the hearing instrument via said inlet member.

14. The hearing instrument according to item 13, wherein said housing of the hearing instrument is provided with an openable lid portion (28) that provides access to said inlet member (1), such that said cavities (12) and (13) that are formed between the inlet member (1) and corresponding inner surface portions of the hearing instrument can be cleaned without removal of the inlet member (1) from the hearing instrument, when the lid portion (28) is opened.

LIST OF REFERENCE NUMERALS

1. inlet member
2. first recess
3. second recess
4. second portion of inlet member
5. first portion of inlet member
6. first microphone
7. second microphone
8. first sound channel
9. second sound channel
10. snout of first microphone
11. snout of second microphone
12. first cavity
13. second cavity
14. inner surface portion of hearing instrument
15. inner surface portion of hearing instrument
16. inner surface portion of hearing instrument
17. inner surface portion of hearing instrument
18. third sound channel
19. fourth sound channel
20. telecoil compartment
21. third recess
22. fourth recess
23. upper covering portion of telecoil compartment
24. undercut
25. undercut
26. bottom shell body of hearing instrument
27. top shell body of hearing instrument
28. lid in top shell body
29. telecoil
30. hole in upper covering portion of telecoil compartment

The invention claimed is:

1. A hearing aid having a microphone, the hearing aid comprising an inlet system configured to let sound from the surroundings enter the microphone, the inlet system comprising:

an inlet member with a main body portion having a first portion and a second portion, the second portion being provided with a first recess formed for accommodating the microphone comprising a microphone body and a sound inlet or snout for conducting sound energy into the interior of the microphone, wherein the first recess is provided with a first sound channel formed for engagement with the sound inlet or snout of the microphone, where the first sound channel at the longitudinal end hereof facing away from the microphone is acoustically coupled to a first cavity, from which first cavity there extends at least one sound channel that provides acoustic communication between the first cavity and one or more outer surface portion(s) of the hearing aid, and wherein at least one of the following is dimensioned so as to provide an acoustic filter that filters ultrasound from an incoming sound signal from the environment to the microphone: the first recess, the sound inlet, the first sound channel, and the first cavity.

2. The hearing aid according to claim 1, wherein the hearing aid comprises a second microphone, and the inlet member further comprises said second portion of said inlet member is provided with a second recess formed for accommodating a second microphone, the second microphone comprising a microphone body and sound inlet or snout for conducting sound energy into the interior of the second microphone, wherein the second recess is provided with a second sound channel formed for engagement with the sound inlet or snout of the second microphone, where the second sound channel at the longitudinal end hereof facing away from the second microphone is acoustically coupled to a second cavity, from which second cavity there extends at least one sound channel that provides acoustic communication between the second cavity and one or more outer surface portion(s) of the hearing aid, and wherein at least one of the following is dimensioned so as to provide an acoustic filter that filters ultrasound from an incoming sound signal from the environment to the second microphone: the second recess, the sound inlet, the second sound channel, and the second cavity.

3. The hearing aid according to claim 1, wherein said first cavity is either formed as an integral part of the main body portion of the inlet system, or wherein the cavity is defined partly by surface portions of the main body of the inlet system and partly by surface portions of the hearing aid.

4. The hearing aid according to claim 1, wherein the sound inlet for each microphone comprises a chimney structure configured to protect the respective microphone from contaminations from the outside.

5. The hearing aid according to claim 2, wherein said second cavity is formed as an integral part of the main body portion of the inlet system, or wherein the second cavity is defined partly by surface portions of the main body of the inlet system and partly by surface portions of the hearing aid.

6. The hearing aid according to claim 1, further comprising a telecoil and wherein said main body portion is furthermore provided with a compartment for accommodating the telecoil.

7. The hearing aid according to claim 1, wherein said main body of the inlet system is made of a flexible or compressible material.

8. An inlet member for a microphone system in a hearing instrument, such as a hearing aid, wherein the inlet member has a main body portion having a first portion and a second portion, the second portion being provided with a first recess formed for accommodating a microphone, the microphone comprising a microphone body and sound inlet or snout for conducting sound energy into the interior of the microphone, wherein the first recess is provided with a sound channel formed for engagement with the sound inlet or snout of the microphone, wherein the sound channel at the longitudinal end hereof facing away from the microphone is acoustically coupled to a third recess formed in the first portion of the main body of the inlet member, the third recess being defined by wall portions that are formed to provide a seal to corresponding inner surface portions of the hearing instrument when the inlet member is mounted in the hearing instrument, wherein at least one of the following is dimensioned so as to provide an acoustic filter that filters ultrasound from an incoming sound signal from the environment to the microphone when the inlet member is mounted in a hearing aid: the first recess, the sound inlet, the first sound channel, and the first cavity.

9. The inlet member according to claim 8, wherein said sound channel extends a distance into said third recess such that a shoulder portion is formed between the entrance of the sound channel and the adjacent wall portions of the third recess, whereby the passage of contaminants from the third recess via the sound channel to the interior of the microphone that is coupled to the sound channel will be prevented or reduced.

10. The inlet member according to claim 8, wherein said second portion of said inlet member is provided with a second recess formed for accommodating a second microphone, the second microphone comprising a microphone body and sound inlet or snout for conducting sound energy into the interior of the microphone, wherein the second recess is provided with a second sound channel formed for engagement with the sound inlet or snout of the microphone, wherein the second sound channel at the longitudinal end hereof facing away from the microphone is acoustically coupled to a fourth recess formed in the first portion of the main body of the inlet member, the fourth recess being defined by wall portions that provide a seal to corresponding inner surface portions of a hearing instrument, when the inlet member is mounted in a hearing instrument.

11. The inlet member according to claim 10, wherein said second sound channel extends a distance into said fourth recess such that a shoulder portion is formed between the entrance of the sound channel and the adjacent wall portions of the fourth recess, whereby the passage of contaminants from the fourth recess via the sound channel to the interior of the microphone that is coupled to the sound channel will be prevented or reduced.

12. The inlet member according to claim 8, wherein said main body portion of the inlet member is furthermore provided with a compartment for accommodating a telecoil.

13. The inlet member according to claim 8, wherein said main body of the inlet member is made of a flexible or compressible material.

14. A hearing instrument comprising at least one microphone and an inlet member according to claim 8 removably mounted in the hearing instrument, wherein the microphone is acoustically coupled to at least one opening provided in the housing of the hearing instrument via said inlet member.

15. The hearing instrument according to claim 14, wherein said housing of the hearing instrument is provided with an openable lid portion that provides access to said inlet member, such that said cavities that are formed between the inlet member and corresponding inner surface portions of the hearing instrument can be cleaned without removal of the inlet member from the hearing instrument, when the lid portion is opened.

16. A hearing aid having a housing with an inlet system for a first microphone positioned in the hearing aid housing, the hearing aid housing having a first end and an opposite second end, the first microphone being arranged at the first end, the inlet system comprising a main body portion having a first portion and a second portion, the first portion being provided with a first recess formed for accommodating the first microphone, a first sound conduit being established from the first microphone to a first opening in the hearing aid housing via the first recess in the first portion, the first sound conduit being dimensioned so as to provide an acoustic low pass filter that filters ultrasound from an incoming sound signal from the environment.

17. The hearing aid according to claim 16, further comprising a second microphone, the second microphone being arranged at the second end of the hearing aid, and the second portion being provided with a second recess formed for accommodating the second microphone, a second sound conduit being established from the second microphone to a second opening in the hearing aid housing via the second recess in the second portion, the second sound conduit being dimensioned so as to provide an acoustic low pass filter that filters ultrasound from an incoming sound signal from the environment.

18. The hearing aid according to claim 16, wherein the first and the second opening in the housing are separated by 1 to 30 mm.

19. The hearing aid according to claim 16, wherein the first opening is formed at a top-part of the hearing aid housing.

20. The hearing aid according to claim 17, wherein the second opening is formed at a top-part of the hearing aid housing.

21. The hearing aid according to claim 16, wherein the inlet system comprises a compartment for accommodating a telecoil.

22. The hearing aid according to claim 19 wherein the inlet system comprises a compartment for accommodating a telecoil, and the compartment is formed in a volume between the first and the second recess and/or the first and the second portion.

23. The hearing aid according to claim 2, wherein the sound inlet for each microphone comprises a chimney structure configured to protect the respective microphone from contaminations from the outside.

* * * * *